US007845300B1

(12) United States Patent
Stroud

(10) Patent No.: US 7,845,300 B1
(45) Date of Patent: Dec. 7, 2010

(54) MODULAR FLOATING MARINE DOCK

(75) Inventor: Wendell H. Stroud, Tacoma, WA (US)

(73) Assignee: Marine Floats Corporation, Tacoma, WA (US)

( * ) Notice: Subject to any disclaimer, the term of this patent is extended or adjusted under 35 U.S.C. 154(b) by 175 days.

(21) Appl. No.: 12/205,783

(22) Filed: Sep. 5, 2008

(51) Int. Cl.
*B63B 35/44* (2006.01)
*E02B 3/00* (2006.01)

(52) U.S. Cl. ..... 114/263

(58) Field of Classification Search ..... 114/253, 114/259, 263, 264, 266, 267
See application file for complete search history.

(56) References Cited

U.S. PATENT DOCUMENTS

| | | | | |
|---|---|---|---|---|
| 1,900,319 | A | | 3/1933 | Vermeulen |
| 2,879,735 | A | | 3/1959 | Pointer |
| 3,012,533 | A | | 12/1961 | Tellefsen |
| 3,073,271 | A | | 1/1963 | Brill |
| 3,073,274 | A | | 1/1963 | Lamb |
| 3,091,203 | A | | 5/1963 | Usab |
| 3,157,144 | A | | 11/1964 | De Jarnett |
| 3,179,076 | A | | 4/1965 | Sheffield |
| 3,323,479 | A | | 6/1967 | Filak |
| 3,448,709 | A | | 6/1969 | Hardwick, Jr. |
| 3,580,202 | A | | 5/1971 | Thompson |
| 3,659,540 | A | | 5/1972 | Toby et al. |
| 3,861,340 | A | | 1/1975 | Clingenpeel |
| 3,977,344 | A | | 8/1976 | Holford |
| 4,041,716 | A | | 8/1977 | Thompson |
| 4,078,515 | A | | 3/1978 | Svirklys |
| 4,223,629 | A | | 9/1980 | Dunlop |
| 4,260,293 | A | | 4/1981 | Peterson |
| 4,316,426 | A | | 2/1982 | Meeusen |
| 4,318,361 | A | | 3/1982 | Sluys |
| 4,318,362 | A | | 3/1982 | Jung |
| 4,365,577 | A | | 12/1982 | Heinrich |
| 4,365,914 | A | | 12/1982 | Sluys |
| 4,418,634 | A | | 12/1983 | Gerbus |
| 4,559,891 | A | | 12/1985 | Shorter, Jr. |
| 4,660,495 | A | * | 4/1987 | Thompson ..... 114/263 |
| 4,709,647 | A | | 12/1987 | Rytand |
| 4,715,307 | A | | 12/1987 | Thompson |
| 4,887,654 | A | | 12/1989 | Rytand |
| 5,845,594 | A | | 12/1998 | Hallsten et al. |
| 7,273,018 | B2 | | 9/2007 | Strong |

* cited by examiner

*Primary Examiner*—Daniel V Venne
(74) *Attorney, Agent, or Firm*—Scott E. Smith; Patrick J.S. Inouye

(57) ABSTRACT

A modular floating marine dock includes a polyethylene float that defines a top surface. A plurality of parallel walers fixedly attaches to the top surface in longitudinal orientation and with a proximal end extending no further than halfway across the top surface. A splicer attaches to and extends beyond the distal end of each waler in parallel orientation and includes attachment points for another waler. A block fixedly attaches to each waler from below and in transverse orientation with a setback from the distal ends of the walers of a distance substantially equal to a width of half the length of the top surface.

16 Claims, 3 Drawing Sheets

MODULAR FLOATING MARINE DOCK

FIELD

This invention relates in general to marine docks and, in particular, to a modular floating marine dock.

BACKGROUND

Over-the-water docks are able to service a greater volume and variety of marine craft compared to docks built along a shoreline. Originally, over-the-water docks were made of timber fixed to sunken pilings driven into the lake or seabed. However, the constant exposure to water and weather lead to rapid deterioration and significantly increased the costs of maintenance and repair.

Floating docks evolved as one solution for providing cost effective over-the-water marine docks. Floating docks utilize buoyant floats over which a deck surface is built. The service life of the dock, though, is closely tied to the continuity of the floats. A loss of watertight integrity can compromise freeboard and lead to eventual dock failure.

Conventional buoyant floats vary in their efficacy. For instance, foam-encapsulated concrete floats rely on rigid shells to preserve the concrete's structural soundness, but such shells are susceptible to cracking due to temperature extremes, which leads to water seepage and eventual failure. Patching provides only a temporary and generally unsatisfactory solution. Further, rebar-reinforced concrete is vulnerable to rust upon exposure to moisture, resulting in irreparable internal weakening. Alternatively, foam-filled rubber tires can function as inexpensive floats, but can suffer from rubber deterioration. Polyethylene foam-filled floats avoid these shortcomings by providing low maintenance expense and long service life.

In general, float repair or replacement often requires the dismantling of an entire dock. One popular floating dock design, such as disclosed in U.S. Pat. No. 4,365,914, to Sluys, utilizes longitudinal wooden walers held against captive floats by transverse tension bars. The tension bars tend to loosen over time as temperature and humidity act on the walers. Moreover, waler replacement entails complete dock dismantling due to the interdependence of floats, decking, walers, and tension rods, which involves significant cost and repair time.

Over-the water docks can adversely affect shoreline marine life by blocking sunlight from submerged vegetation and shallow dwelling creatures. Conventional floating docks inadequately permit light-through, which frequently is provided by ad hoc design. Provisionings for light penetration are irregular and occur by happenstance where dock construction permits, such as with staggered float placement or on top of walers having sufficient uninterrupted run.

SUMMARY

A modular floating marine dock includes a polyethylene float that defines a top surface. A plurality of parallel walers fixedly attaches to the top surface in longitudinal orientation and with a proximal end extending no further than halfway across the top surface. A splicer attaches to and extends beyond the distal end of each waler in parallel orientation and includes attachment points for another waler. A block fixedly attaches to each waler from below and in transverse orientation with a setback from the distal ends of the walers of a distance substantially equal to a width of half the length of the top surface.

Still other embodiments will become readily apparent to those skilled in the art from the following detailed description, wherein are described embodiments by way of illustrating the best mode contemplated. As will be realized, other and different embodiments are possible and their several details are capable of modifications in various obvious respects, all without departing from the spirit and the scope. Accordingly, the drawings and detailed description are to be regarded as illustrative in nature and not as restrictive.

DETAILED DESCRIPTION

Figure 1:
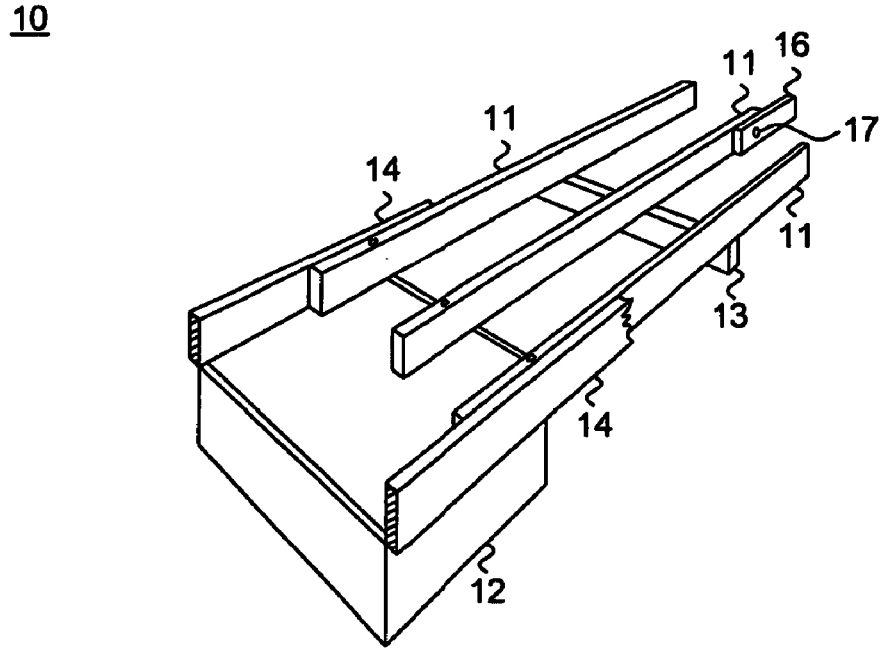
FIG. 1 is a perspective view of a modular floating marine dock without decking in accordance with one embodiment.

An over-the-water dock suitable for use as a public, private, or commercial marina can be built through assembly of individual modular floating marine docks. FIG. 1 is a perspective view of a modular floating marine dock 10 without decking in accordance with one embodiment. The modular floating marine dock 10 utilizes a float 12 to maintain buoyancy in the water. The float 12 is manufactured from polyethylene by rotomolding resulting in floats 12 of uniform size and shape. The float 12 is generally rectangular shaped with a length of five feet, width of four feet, and height of two feet. Other float 12 sizes and shapes are possible depending on load requirements. The walls of the float 12 taper gradually inward from top to bottom. The float 12 is foam-filled and airtight sealed, so that the float will maintain buoyancy, even when punctured or cracked. An extruded ridge is formed along the edge of the top surface of the float 12 to provide attachment points by upwardly driven bolts running through the float 12 to the frame of the modular floating marine dock 10.

One or more parallel walers 11, also known as wales, are attached to the ridge on each side of the float 12. The float 12 can be attached to the walers 11 by bolts, screws, glue, or other fastening means. Preferably, the ridge has receiving points for bolts that extend from the underside of the ridge into the bottom of the walers 11. Walers 11 are preferably constructed of pressure treated wood, though other corrosion resistant marine quality materials could be used. The walers 11 run from the midpoint of the float 12 for a length sufficient to accommodate spacing between the next float. The spacing allows accommodation of regularly-arranged light-through decking, as further described below with reference to FIG. 3. Outer walers 11 are preferably three inches by eight feet boards while inner walers 11 have smaller girth, such as two inches by eight feet. Other board sizes are possible depending on loading requirements. Crossbeams (not shown) connect adjacent walers 11 via L-brackets to provide further structural support, as discussed further below with reference to FIG. 5. The crossbeams are generally of the same material as the walers 11.

Fascia 14 can be attached to the outside of the outermost walers 11 and run along the longitudinal edge of the dock.

Fascia 14 provides further support to the modular floating marine dock 10 and a surface for boats and marine craft to come into contact while docking. The fascia 14 can be attached to the walers 11 by bolts or other fasteners. The fascia 14 are shown diagrammatically broken for clarity but extend along the full length of the modular floating marine dock 10. Further, fascia 14 can be provided at each end of the dock to enclose the ends. The top of the fascia 14 extends above the top of the walers 11 by a height equal to the thickness of the decking material used. In a further embodiment, the top of the fascia 14 and walers 11 are flush. Fascia 14 are generally pressure treated wood though other materials could be used. A rub strip (not shown) can also be attached to the outer facing of the fascia 14 to provide cushioning and a non-scratch surface for docking.

Individual modular floating marine docks 10 can be connected to construct docks of varying sizes. Splicers 16, or splices, removably connect the walers 11 of one modular floating marine dock 10 to a second modular floating marine dock 10. A block 13 from one individual modular floating marine dock 10 is placed against the float 12 of the adjoining modular floating marine dock 10 to provide support to the float 12.

Figure 2:
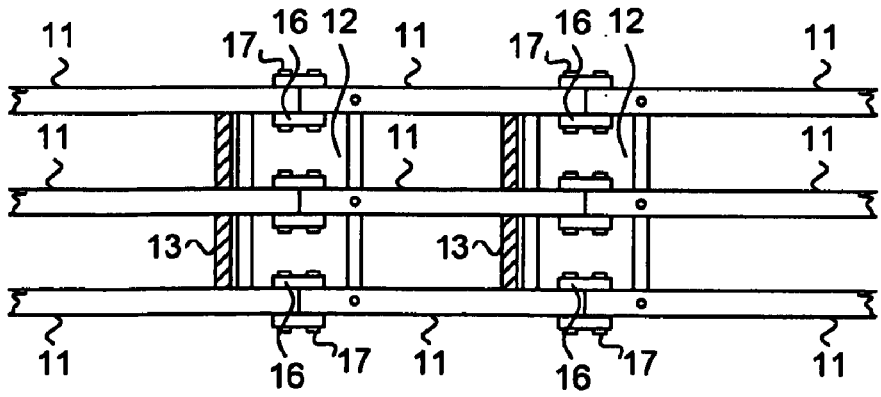
FIG. 2 is a partial top plan view of laterally interconnected modular floating marine docks.

Splicers 16 attach to the end of the walers 11 farthest from the float 12 to connect one modular floating marine dock 10 to another modular floating marine dock 10, as further discussed below with reference to FIG. 2. For clarity, only a single splicer 16 is shown. Generally, splicers 16 are of the same material as the walers 11, though different combinations of splicer 16 and waler 11 materials are possible. Splicers 16 can attach to the walers by bolts 17 or other fasteners.

A block 13 is attached transverse to the dock across the bottom sides of the walers 11. The distance from the block 13 to the end of the waler 11 is approximately half the width of the float 12. When a second modular dock is fit, the block 13 sits against the second float and the block 13 forms the spacing between the two docks. As the float 12 is attached to the walers 11 only at one side, the block 13 provides further support to the float 12 against the force of waves and tidal flow, yet allows for heat expansion and stress relief.

Decking (not shown) can be placed on, and supported by, the top surfaces of the walers 11. Different decking materials can be used, as further discussed below with reference to FIGS. 3 and 4. Preferably, the top of the decking is flush to the top of the fascia 14. In a further embodiment, the decking fully covers the fascia 14. Conduits for water, electrical, and utility services (not shown) can be provided under the decking. Additionally, decking features (not shown), such as water taps, electrical outlets, lighting, and dock piling fittings can be provided, as will be known to one skilled in the art. Other decking features are possible.

The modularity of the dock float 10 allows for multiple dock floats 10 to be interconnected to create floating docks of varying length and breadth. FIG. 2 is a partial top plan view of laterally interconnected modular floating marine docks 10. The modular arrangement of each floating marine dock 10 facilitates efficient removal for repair, maintenance, or replacement and full dock dismantling is unnecessary. The splicers 16 interconnect one modular floating marine dock 10 to another modular floating marine dock 10 with the assistance of the blocks 13. Each splicer 16 that is attached to the end of a waler 11 of one modular floating marine dock 10 is connected to the end of the waler 11 above the midpoint of the float 12 of the next modular floating marine dock 10. Preferably, the splicer 16 is removably attached to the walers 16 by means of bolts 17, screws, or fasteners. Other attachment means are possible.

The block 13 from one modular floating marine dock 10 is positioned so that the block 13 abuts the closest edge of the float 12 of the next modular floating marine dock 10. The block 13 can be fixedly or removably attached to the walers 11 by bolts or screws, though other attachment means are possible. The block 13 helps to maintain position and stability of the float 12 that the block 13 abuts, while also accommodating thermal expansion and stress relief. Attaching the float 12 to walers 11 at one end while the block 13 presses against the opposite side of the float 12 prevents the float 12 from moving while allowing individual modules 10 to be exchanged as needed.

Figure 3:
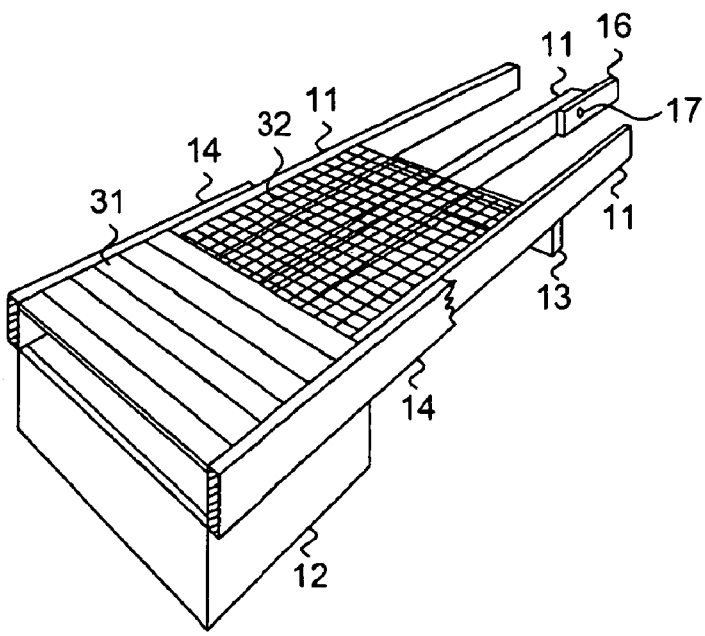
FIGS. 3 and 4 are perspective views of the modular floating marine dock of FIG. 1 respectively provided with wood and concrete decking and light-through accommodations.
Figure 4:
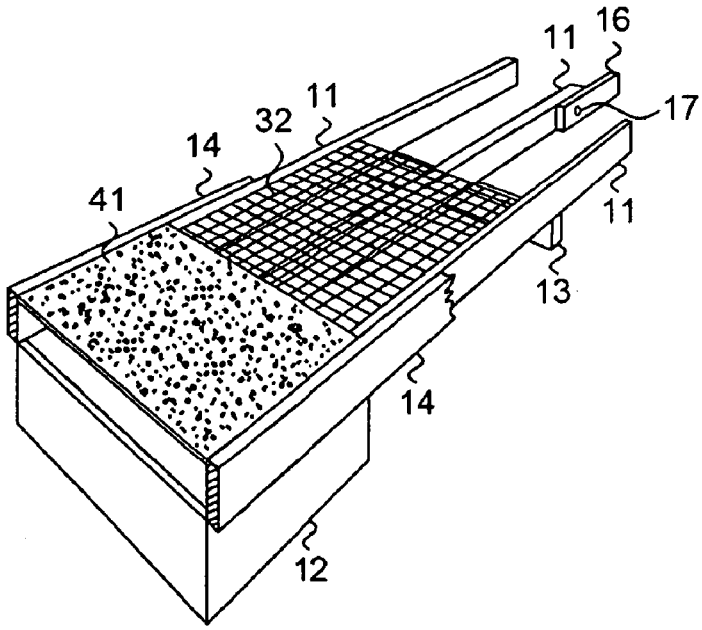

A variety of decking surfaces can be used in conjunction with the modular floating marine dock 10. FIGS. 3 and 4 are perspective views of the modular floating marine dock 10 of FIG. 1 respectively provided with wood and concrete decking 31 and light-through accommodations 32. The decking 31, 32 can be attached to the walers 11 by bolts, screws, nails, or other suitable means. Other decking 31, 32 attachment means are possible. In a further embodiment, the decking 31, 32 is of sufficient weight so that the decking 31, 32 can be placed on top of the walers 11 without the need of attaching the decking 31, 32. In a further embodiment, the decking 31, 32 is placed on top of the walers 11 without attachment and maintained in position by the fascia 14 surrounding and "sandwiching" the decking 31, 32 in place.

The decking 31, 32 is fabricated of a durable material, for example, concrete, recycled plastic lumber (RPL), wood, or steel. Other decking materials are possible. Preferably, a solid decking 31 is installed above the float 12, while a light pass-through decking 32, such as a polypropylene, fiberglass, or steel grate, is installed above areas between floats so that light can reach the water surface below. Other decking 31, 32 configurations are possible. The decking 31, 32 is installed so that the top of the decking 31, 32 is flush with the top of the fascia 14. In a further embodiment, the decking 15 extends across the top of the fascia 14.

Figure 5:
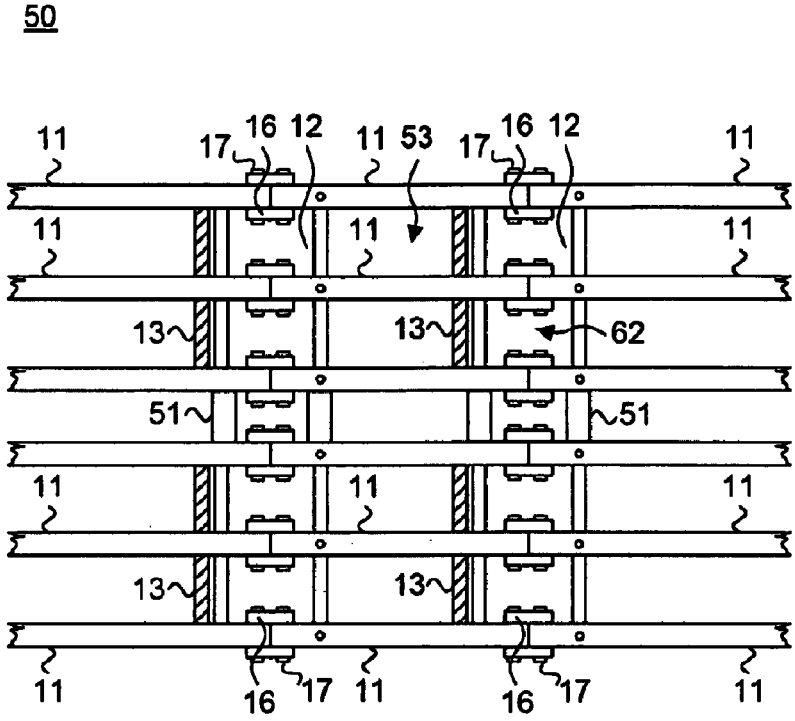
FIG. 5 is a partial top plan view of transversely interconnected modular floating marine docks.

Modular floating marine docks 10 can be combined to attain not only desired dock and marinas lengths, but widths as well. FIG. 5 is a partial top plan view of transversely interconnected modular floating marine docks 10. Decking 31, 32 has been removed for clarity. Modular floating marine docks 10 can be connected adjacently to attain a required dock width. The adjacent modular floating marine docks 10 are attached to one another by crossbeams 51 that transversely connect one of the outside waters 11 from one modular floating marine dock 10 to the nearest waler 11 of the adjacent modular floating marine dock 10. Crossbeams 51 can connect waters 11 by L-brackets. Other attachments means are possible. Adjacent floats 12 can abut one another (not shown) or can be placed so that a space 52 exists between adjacent floats 12. Preferably, the decking 31 (not shown) used to cover adjacent floats 12, including the spaces 42 between adjacent floats 12 is a solid material, such as concrete, RPL, or wood, while the spaces 53 between lengthwise floats 12 are covered with a light-through material 32, such as a grating. Other decking 31, 32 materials and configurations are possible. The decking 31, 32 is attached to, or placed on top of, the waters 11 (not shown). The top surface of the decking 31, 32 is flush with the top surface of the fascia 14. In a further embodiment, the decking 31, 32 covers the top of the fascia 14.

Figure 6:
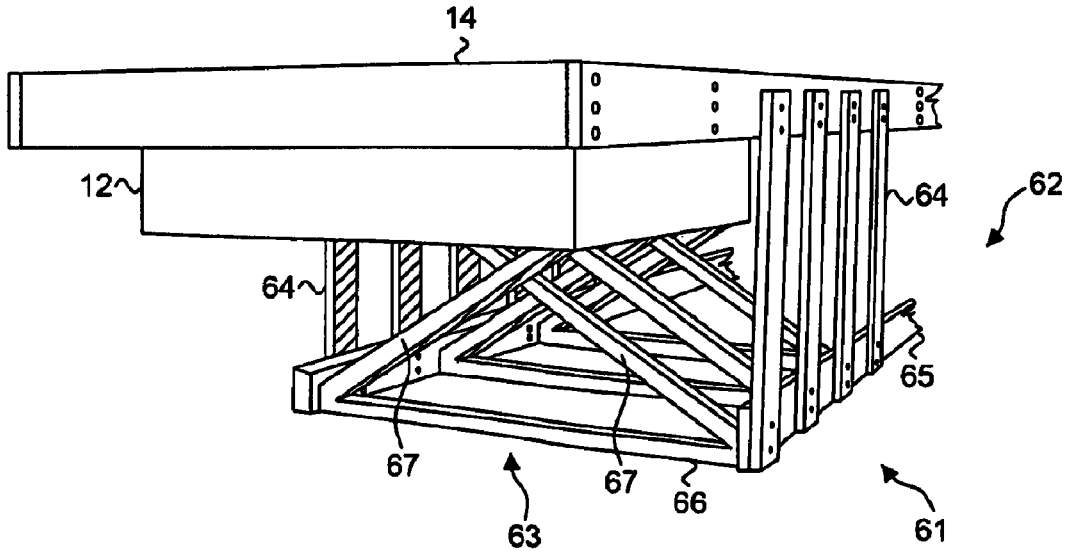
FIG. 6 is a partial perspective view of a modular floating marine dock with a wave attenuator in accordance with a further embodiment.

Wave attenuation increases the ability of the modular floating marine dock 10 to resist movement caused by oncoming waves or cross currents. FIG. 6 is a partial perspective view of a modular floating marine dock 10 with a wave attenuator 61 in accordance with a further embodiment. A modular floating marine dock 10 can include a wave attenuator 61 to dissipate or refract oncoming waves. The wave attenuator 61 increases the mass, and lowers the center of gavity, of the modular floating marine dock 10, which increases the modular floating marine dock's 10 wave dissipation due to waves created by current, wind, and boat wakes.

In one embodiment, the wave attenuator 61 consists of a frame 62 attached to the outside of the fascia 14 and an interior truss 63 connected to the frame 62 and the bottom of the float 12. The frame 62 is composed of vertical legs 64 attached at one end to the fascia 14 and at the other end to a transverse beam 65 oriented parallel to the fascia 14. The interior truss 63 consists of three struts 66, 67 in roughly triangular shape. A horizontal strut 66 is attached to the interior side of two opposite transverse beams 65. Two diagonal struts 67 extend from the opposite transverse beams 65 to the bottom of the float 12 where they are attached. Other wave attenuator configurations are possible.

While the invention has been particularly shown and described as referenced to the embodiments thereof, those skilled in the art will understand that the foregoing and other changes in form and detail may be made therein without departing from the spirit and scope of the invention.

What is claimed is:

1. A modular floating marine dock, comprising:

a polyethylene float defining a top surface;

a plurality of parallel walers fixedly attached to the top surface in longitudinal orientation and with a proximal end extending no further than halfway across the top surface;

a splicer attached to and extending beyond the distal end of each waler in parallel orientation and comprising attachment points for another waler; and a block fixedly attached to each waler from below and in transverse orientation, wherein the block is placed at a distance from the distal ends of the walers substantially equal to a width of half the length of the top surface.

2. A modular floating marine dock according to claim 1, further comprising:

a decking attached to the top surfaces of the walers; and a fascia attached to an outboard side of the polyethylene float with a top surface flush with the top surfaces of the walers.

3. A modular floating marine dock according to claim 2, wherein the decking is composed of at least one of concrete, wood, and recycled plastic lumber.

4. A modular floating marine dock according to claim 1, further comprising:

a decking attached to the top surfaces of the walers; and a fascia attached to an outboard side of the polyethylene float with a top surface extending above top surfaces of the walers in an amount substantially equal to a thickness of the decking.

5. A modular floating marine dock according to claim 4, wherein the decking is composed of at least one of concrete, wood, and recycled plastic lumber.

6. A modular floating marine dock according to claim 1, wherein the polyethylene float further defines a lip extending outward from a main float body and fixedly attaching the float to the waler by fasteners extending upwards through the lip into a bottom surface of the waler.

7. A modular floating marine dock according to claim 1, wherein the block is placed non-adjacently to a nearside of the float defining an open space.

8. A modular floating marine dock according to claim 7, further comprising:

a decking placed over the open space and fastened to top surfaces of the walers.

9. A modular floating marine dock according to claim 8, wherein the decking is one of a solid material and a light-permeable material, wherein further the solid material is placed above the float and the light-permeable material is placed above the open space.

10. A modular floating marine dock according to claim 7, further comprising:

a further polyethylene float placed in the open space.

11. A modular floating marine dock according to claim 10, wherein the further float is fixedly attached on one side to the walers and blocked in on an other side.

12. A modular floating marine dock according to claim 1, wherein the splicer attachment points consist of bolts.

13. A modular floating marine dock according to claim 1, further comprising:

a plurality of floats laterally attached.

14. A modular floating marine dock according to claim 1, further comprising:

a plurality of floats adjacently joined.

15. A modular floating marine dock according to claim 14, wherein the floats adjacently joined are one of abutting or non-abutting defining an open space.

16. A modular floating marine dock according to claim 1, further comprising:

a wave attenuator attached to an outboard side of a fascia and a bottom surface of the polyethylene float.

* * * * *